United States Patent [19]

Quaintance

[11] Patent Number: 4,600,142

[45] Date of Patent: Jul. 15, 1986

[54] REVERSE ELBOW LOCK FLAP PRODUCE BOX

[75] Inventor: Benjamin W. Quaintance, Griffin, Ga.

[73] Assignee: International Paper Company, New York, N.Y.

[21] Appl. No.: 671,826

[22] Filed: Nov. 15, 1984

Related U.S. Application Data

[63] Continuation-in-part of Ser. No. 574,496, Jan. 27, 1984, abandoned.

[51] Int. Cl.[4] ..... B65D 5/20

[52] U.S. Cl. ..... 229/143; 229/45 R; 229/109; 229/149; 229/193; 229/177; 229/918; 229/DIG. 2; 229/DIG. 11

[58] Field of Search ..... 229/31, 31 FS, 33, 34 R, 229/34 B, DIG. 11, 39 R, 16 R, 45 R, 44 R, 36, 38, 35, DIG. 2

[56] References Cited

U.S. PATENT DOCUMENTS

| | | | |
|---|---|---|---|
| 687,704 | 11/1901 | Unser . | |
| 1,102,445 | 7/1914 | Schwab . | |
| 1,218,353 | 3/1917 | Bachmann | 229/34 R |
| 1,700,758 | 2/1929 | Berkowitz . | |
| 1,950,104 | 3/1934 | Ewers | 229/39 R |
| 2,105,057 | 1/1938 | Sharpe . | |
| 2,115,867 | 5/1938 | McConnell | 229/16 R |
| 2,276,820 | 3/1942 | Bonfield | 229/45 R |
| 2,536,948 | 1/1951 | Lehman . | |
| 2,572,610 | 10/1951 | Gilbert . | |
| 2,686,002 | 8/1954 | Inman | 229/39 R |
| 2,838,222 | 6/1958 | Papadopoulos . | |
| 2,904,238 | 9/1959 | Perry et al. | 229/39 R |
| 2,949,221 | 8/1960 | Vander Lugt, Jr. . | |
| 3,286,908 | 11/1966 | Ellis | 229/44 R |
| 3,368,734 | 2/1968 | Wainberg | 229/87 R |
| 3,669,341 | 6/1972 | Hughes . | |
| 3,883,067 | 5/1975 | McGlynn et al. | 229/34 R |
| 3,935,991 | 2/1976 | Crane | 229/34 R |
| 4,017,019 | 4/1977 | Booth | 229/39 R |
| 4,082,215 | 4/1978 | Eichenauer . | |
| 4,239,148 | 12/1980 | Sorenson et al. | 229/45 R |
| 4,347,968 | 9/1982 | Cornell et al. . | |

FOREIGN PATENT DOCUMENTS

| | | | |
|---|---|---|---|
| 964245 | 3/1975 | Canada | 229/44 R |
| 996112 | 8/1951 | France | 229/35 |
| 2237466 | 2/1975 | France | 229/31 FS |
| 2423404 | 12/1979 | France | 229/33 |
| 2494221 | 5/1982 | France | 229/33 |
| 1439600 | 6/1976 | United Kingdom | 229/33 |

*Primary Examiner*—William Price
*Assistant Examiner*—Gary E. Elkins
*Attorney, Agent, or Firm*—Richard J. Ancel

[57] ABSTRACT

A box or container for yams or other bulk products wherein there are closure panels having lock panels at each end thereof, and which lock panels interlock in lock notches formed in end panels carried by a bottom panel of the box. The relationship between the lock panels, which includes bent elbow hooks, and the lock notches is one wherein the required locking action is easily effected and wherein the locks may be readily released for inspection. The box preferably has a three layer end wall construction including end panels carried by the bottom panel and other end panels carried by side panels of the box. The box is readily stackable and has tapered sides and vent openings so as to permit circulation between and within stacked boxes. In one modification the box is formed from a tube, the tube being formed by joining together the ends of a unitary blank to thereby form a manufacturer's joint, the blank defined by a plurality of hinged, articulated panels. All embodiments exhibit top closure panels which do not require stapling after container loading and which exhibit resistance to unintentional opening.

24 Claims, 19 Drawing Figures

14
14

FIG. 17
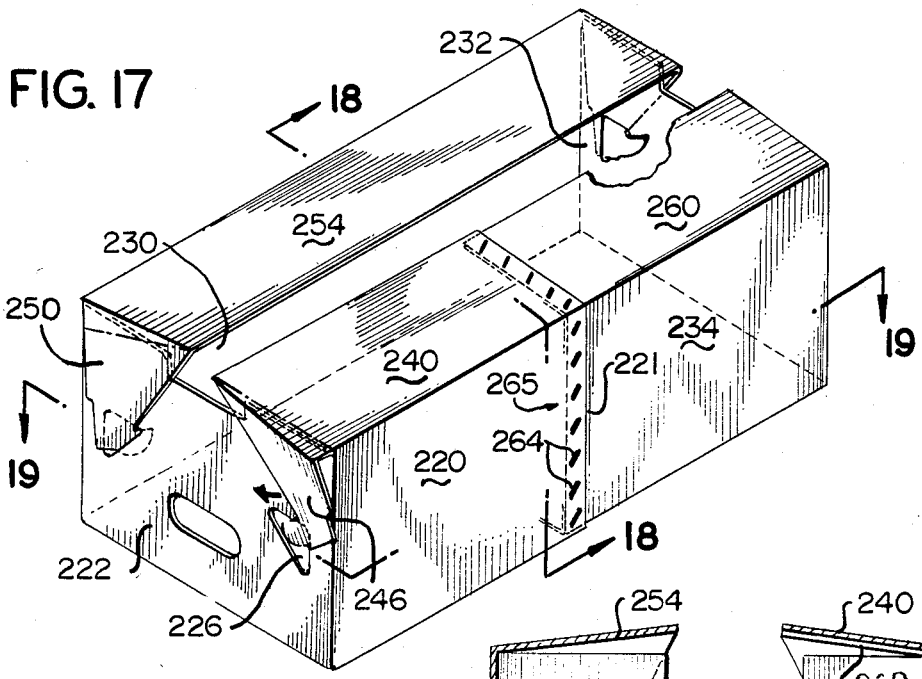
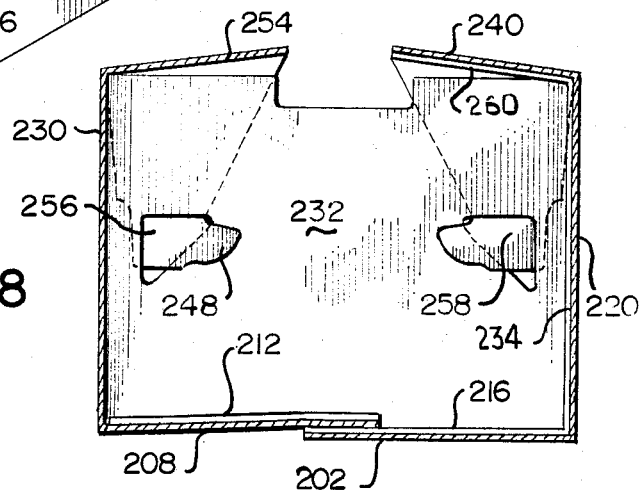
FIG. 18
FIG. 19
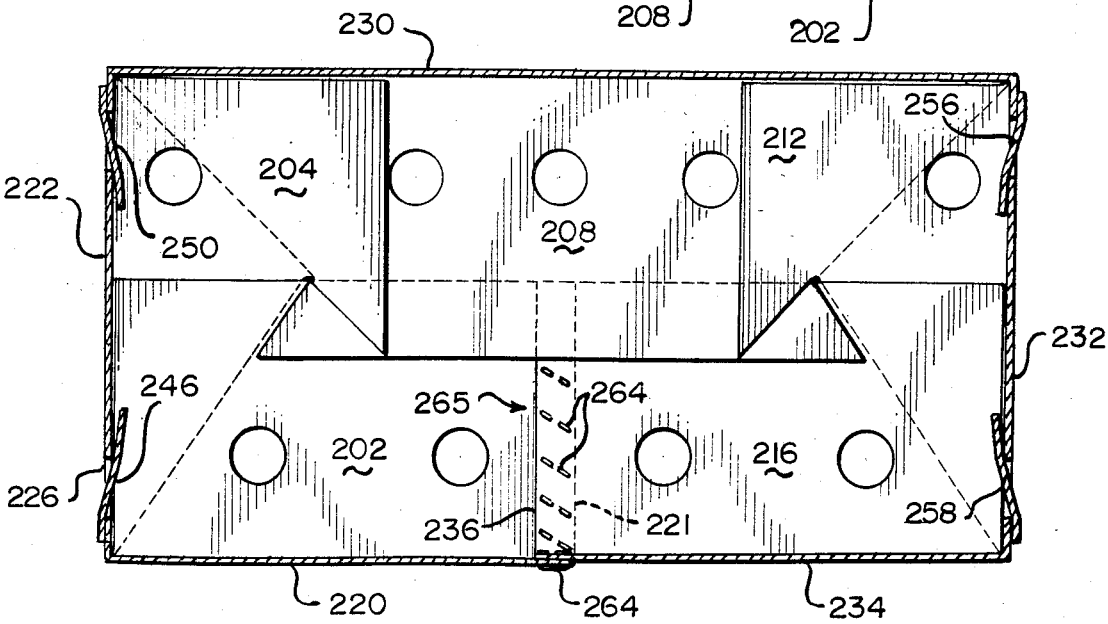

REVERSE ELBOW LOCK FLAP PRODUCE BOX

This is a continuation-in-part application of my copending application entitled REVERSE ELBOW LOCK FLAP PRODUCE BOX, filed Jan. 27, 1984, as Ser. No. 574,496, now abandoned.

This invention relates in general to new and useful improvements in boxes for the shipment of produce, and more particularly to a box particularly constructed for holding and shipping yams and like shaped produce.

The traditional 50-pound container of the shipment of yams is a two piece, full telescoping, half-slotted box with vent slots and hand holes, which may or may not be wax impregnated. The wax impregnation in the body is there to resist the moisture of the wet potatoes as they are packed. The full telescoping cover allows easy access for inspection of the potatoes and permits overpacking of the container.

Both body and cover are assembled on electric post stitchers by hand. (Most operations are too small for automation.) The post stitcher is a constant source of complaints among packers. The stitchers jam and break down regularly. The present box packs and closes easily, although the telescoping cover can be clumsy to put over an overpacked box body.

The unitizing of the existing box generates a stable, but rough looking unit. The boxes are unitized 40 per pallet; 8 boxes per layer, and cross-tie stacked five layers high. Basically, the boxes all crush and nest together, creating a stable but rather poor appearance.

Ventilation with the palletized unit is minimal at best. Ventilation slots have traditionally been placed in the middle of the length panel where they do the most damage to the package structure and generate the least possible air circulation.

As it exists, the present yam box is easy to manufacture and relatively easy to use, but it provides a rather poor agricultural container.

Attention is also directed to prior box constructions as defined in the U.S. Pat. Nos. to Unser 687,704; Schwab 1,102,445; Berkowitz 1,700,758; Sharpe 2,105,057; Lehman 2,536,948; Gilbert 2,572,610; Papadopoulos 2,838,222; Vander Lugt 2,949,221; Hughes 3,669,341; Eichensuer 4,082,215; and Cornell 4,347,968.

In accordance with this invention there has been developed a container or box to particularly pack and ship yams as an agricultural product in the agricultural environment. The box is a one piece tray style package with top flaps, score line vents and a triple ply hand hold.

The box set up and closure are totally self-contained, that is, no glue, staples or straps are needed. The self-lock body assembly has proven to be a simple fast and secure device. Closure panels of the box are provided at each end thereof with a lock panel utilizing a unique reverse elbow lock. This lock will close even when the box is grossly overpacked and yet it can easily be reopened, inspected and closed.

Most particularly, the lock construction, which is between the closure panels and the end panels carried by the bottom panel, will permit the closure panels to bulge upwardly and tilt when the packer has a tendency to overfill the box.

To insure good ventilation, the box profile may be slightly tapered upwardly and score line vents are arranged to align in a palletized stack.

Basically, the box is for forming a specialized agricultural package. It simplifies and maximizes the movement of a particular agricultural product, such as yams, from the fields through the distribution channels to the produce market. It will be understood, however, that the box of this invention is also suitable for the bulk packaging of non-agricultural products.

IN THE DRAWINGS

FIG. 17 is a perspective view, partially broken away, showing the box after it has been erected from the flattened position of FIG. 16.

FIG. 18 is a transverse cross-sectional view taken along section 18—18 of FIG. 17.

FIG. 19 is a longitudinal cross-section taken along section 19—19 of FIG. 17.

Figure 1:
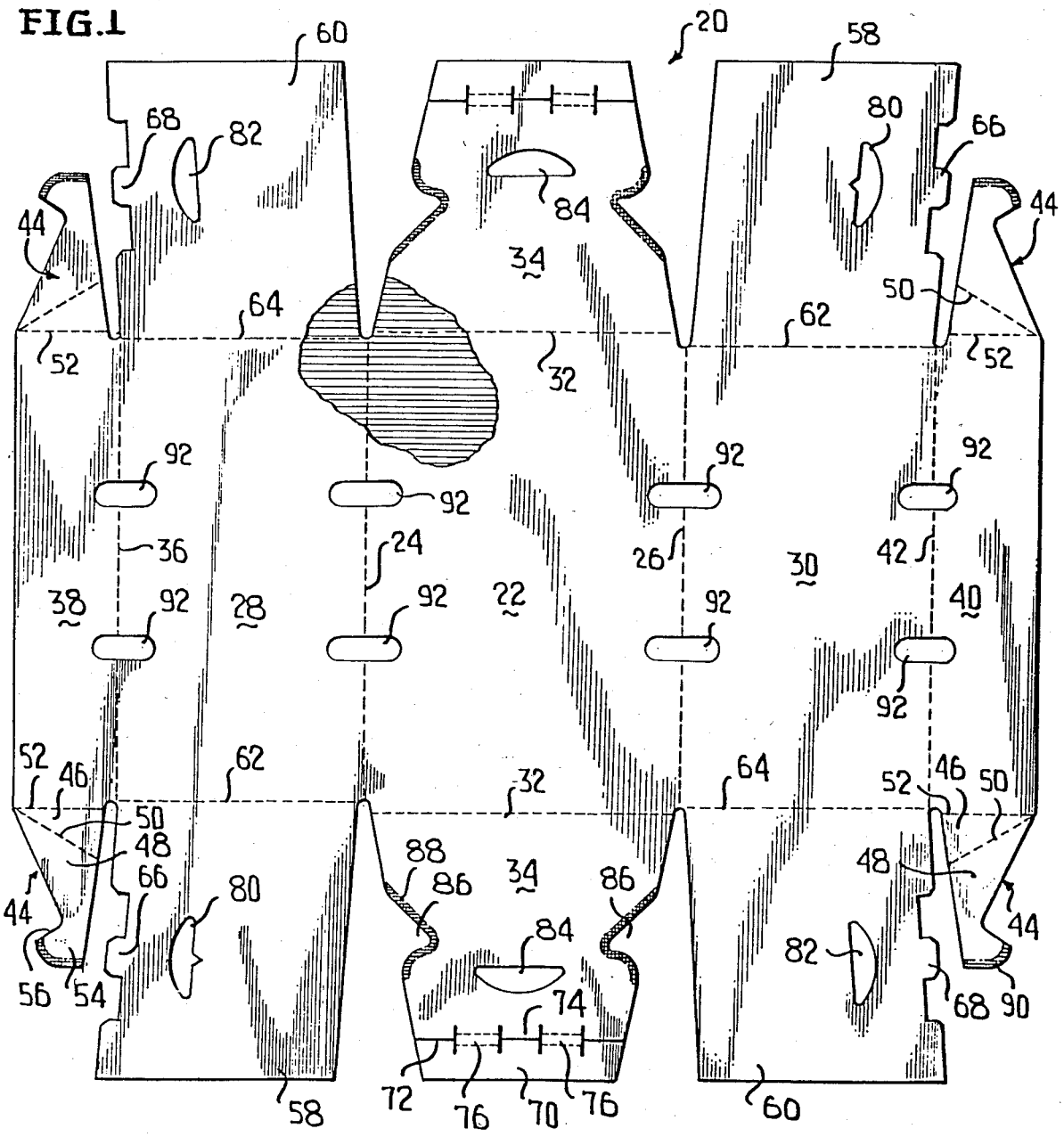
FIG. 1 is a plan view of a blank from which the box is formed.

Referring now to the drawings in detail, reference is made to FIG. 1 wherein there is illustrated a blank 20 from which a preferred embodiment of the box is formed. The blank is formed of corrugated board which may include a wet strength liner and medium, as well as special water repellent inside coatings.

The blank 20 includes a centrally located bottom panel 22 which has connected to opposite sides thereof a long hinge or fold lines 24, 26 side panels 28, 30 respectively.

The bottom panel 22 has connected to opposite ends thereof along hinge or fold lines 32 end panels 34.

The side panel 28 has connected thereto remote from the bottom panel 22 along a hinge or fold line 36 a closure panel 38. A similar closure panel 40 is connected to the side panel 30 remote from the bottom panel 22 along a hinge or fold line 42.

Each of the closure panels 38, 40 is provided at each end thereof with a lock panel generally identified by the numeral 44. Each lock panel 44 is formed in two sections and includes an inner section 46 connected to an outer section 48 along a diagonal hinge or fold line 50. The inner section 46 is connected to its respective closure panel along a hinge or fold line 52. Each lock panel 44 slants or tapers away from the longitudinal axis of its respective side panel as may be seen in FIGS. 1, 4 and 8, for example.

The outer section 48 terminates in a reverse elbow hook 54 having a locking edge 56. It is to be noted that the lock panel tapers in width toward the hook 54.

At the opposite ends of the side panels 28, 30 are closure panels 58, 60 which are connected to their respective side panels along hinge or fold lines 62, 64. It is to be noted that the positions of the end panels 58, 60 are reversed with respect to the closure panels 28, 30.

It is also to be noted that the fold lines 62 are disposed the closest to the longitudinal center of the blank are the fold lines 32 are located the furtherest from the longitudinal center of the blank. The fold lines 64 have intermediate positions. Thus the end panels 58 may be first folded in position, then the end panels 60, and finally the end panels 34.

The upper edge of each of the end panels 58 and 60 is stepped so that each end panel 58 has a central upstanding tab 66 and each end panel 60 has a central upstanding tab 68. Further, each end panel 34 is provided with a locking flap 70 defined by a combination of cut and fold lines 72 so that when the flap is folded, each end panel 34 will have a stepped edge including a central tab 74. On opposite sides of the tab 70, the connection between the locking flap 70 and the end panel 34 is defined by webs 76 which serve to lock together the aligned end panels 58, 62 and 34 at the opposite ends of the box, as shown in FIG. 3, the box being generally identified by the numeral 78.

It is also to be noted that the end panels 58 have optionally formed therein hand holes 80 which are aligned with hand holes 82 formed in the end panels 60 and hand holes 84 formed in the end panels 34. If desired, the configuration of the optional hand holes 80 may be different from those of the hand holes 82, 84 so as to indicate that the end panels 58 are to be first folded into position, as is shown in FIG. 2.

It is also pointed out here that the end panels 34 are tapered and have formed in opposite sides thereof a lock notch 86. If desired, the material of the end panels 34 defining the lock notches 86 may be crushed as at 88. Additionally, the material around the tip of the hook 54 may also be crushed as at 90.

Figure 2:
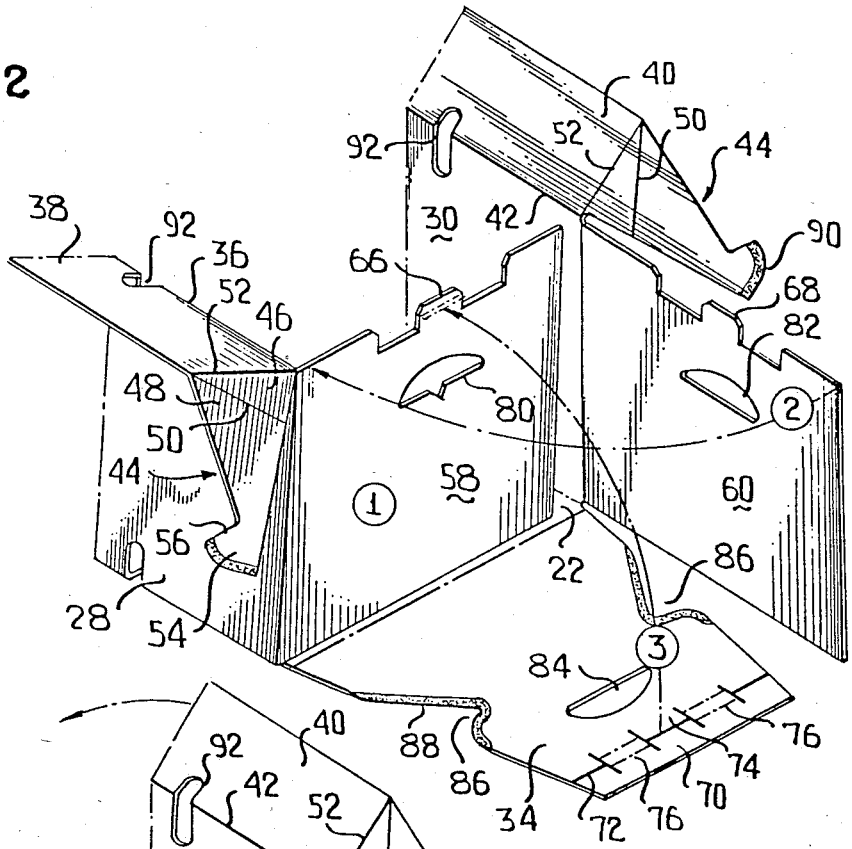
FIG. 2 is a perspective view of one end of the box showing the manner in which end panels thereof are sequentially folded.
Figure 3:
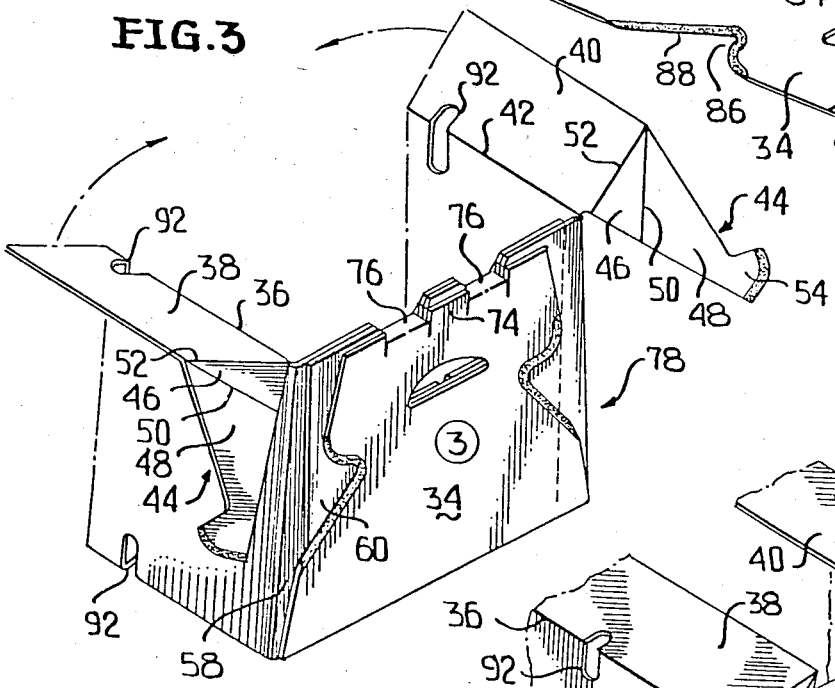
FIG. 3 is a fragmentary perspective view similar to FIG. 2 with the end panels folded into position and interlocked and the box ready to receive produce.
Figure 4:
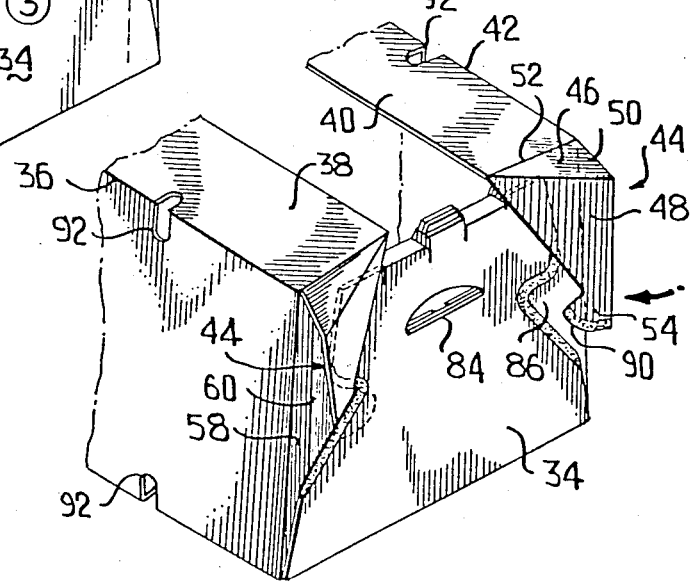
FIG. 4 is another fragmentary perspective view showing the manner in which the closure panels are locked in position after the box has been filled.

Referring now to FIGS. 2–4, it will be seen that in the erection of a box 78, the side panels 28, 30 will be first folded upwardly relative to the bottom panel 22, after which the end panel 58 is first folded into position as shown in FIG. 2. Then the end panel 60 is folded into position, followed by the folding of the end panel 34 into position. Once the end panels 58, 60 and 34 and an end of the box have been folded into position, the locking flap 70 carried by the end panel 34 will be folded over the end panels 58, 60 to lock the end panels in place.

After both the ends of the box have been formed in the manner described, the box is in the form of a tray ready to receive the product to be packaged, such as yams. After the box has been filled, the closure panels 38, 40 are folded into position overlying the product and the lock panels 44 are locked with the end panels 34 by swinging the hooks 54 into the lock notches 86 in the manner generally shown in FIG. 4. At this time the box is completed with the produce packaged therein.

Figure 5:
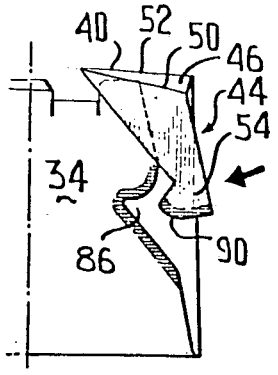
FIG. 5 is a schematic fragmentary end view of the box showing the initial movement of the lock hook into the lock notch.
Figure 6:
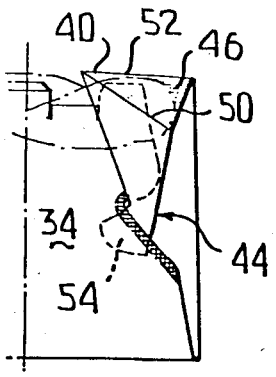
FIG. 6 is a view similar to FIG. 5 showing the lock hook fully engaged in the lock notch.

With reference to FIG. 5, it is to be noted that the hook 54 of each lock panel 44 may be swung into the lock notch 86 and behind the end panel 34 due to the lock flap 44 being formed in two sections joined along the diagonal fold line 50. The completed lock is best shown in FIG. 6.

Figure 7:
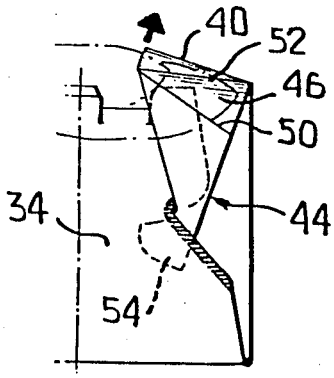
FIG. 7 is a view similar to FIG. 6 but showing the associated closure panel in an upwardly bowed tilted position due to overfilling of the box.

In FIG. 7 it is shown how the construction of the lock panels permit the upward bulging and tilting of the closure panels 40.

It is to be understood that the inner lock between the hooks 54 and the lock notches 86 will be maintained during the normal handling of the box 78, but wherein one can easily swing the hooks to three positions for the purpose of inspecting the contents of the box.

The closure panels 38, 40 in the closed position of the box are spaced apart so as to permit inspection of the product and also freedom of ventilation.

With respect to the question of ventilation, with reference to FIG. 1, it will be seen that extending across each of the fold lines 24, 26 and the fold lines 36, 42 are score defined vent openings 92. Furthermore, it is to be noted in the erected box 78, the side panels 28, 30 taper upwardly so that there is a spacing between adjacent boxes when stacked. This permits sufficient ventilation of the product packed within the boxes 78.

Figure 8:
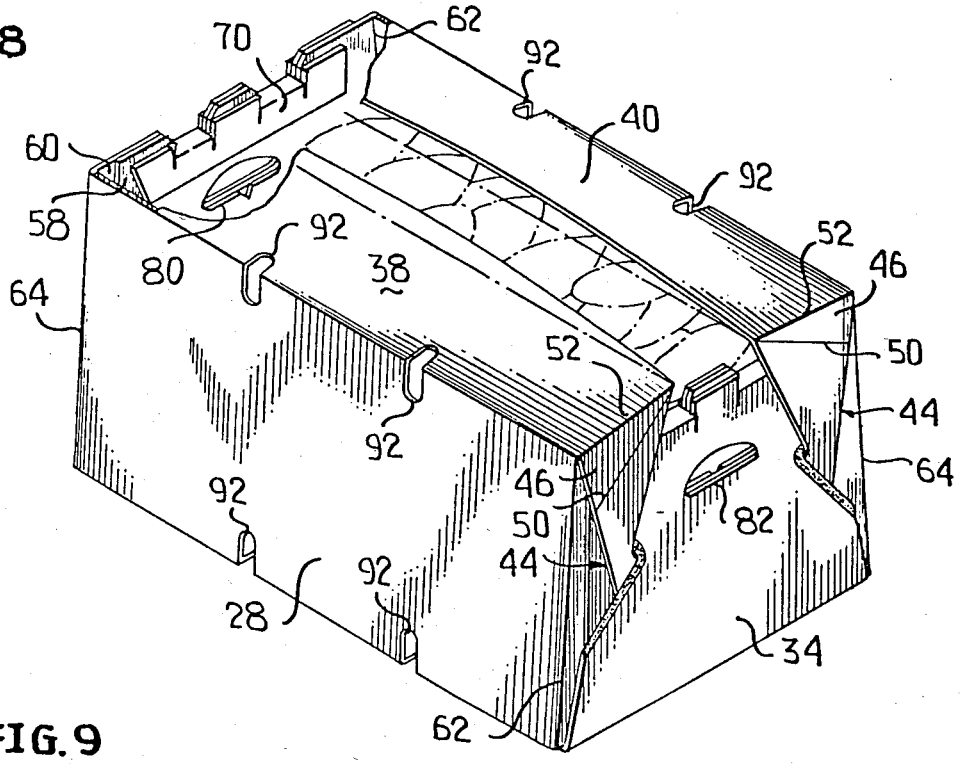
FIG. 8 is a perspective view with parts broken away of a completed and filled box.

The detail of a completed box 78, including the position of the locking flaps 70, are clearly shown in FIG. 8. It will be understood that the width of panels 38 and 40 (see FIG. 1) may be increased so that these edges would abut in the assembled box of FIG. 8. Further, the box need not be tapered.

Figure 9:
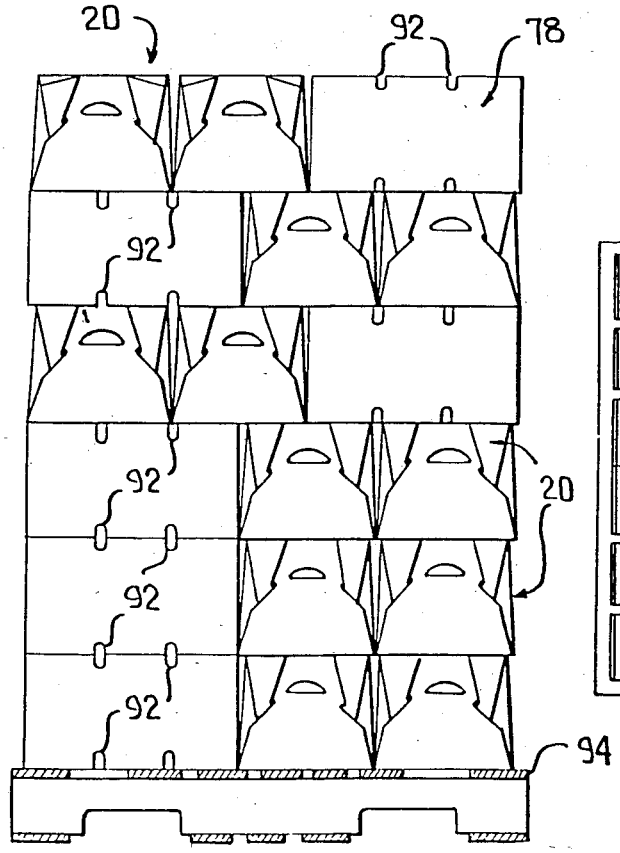
FIG. 9 is an elevational view showing boxes stacked on a pallet.
Figure 10:
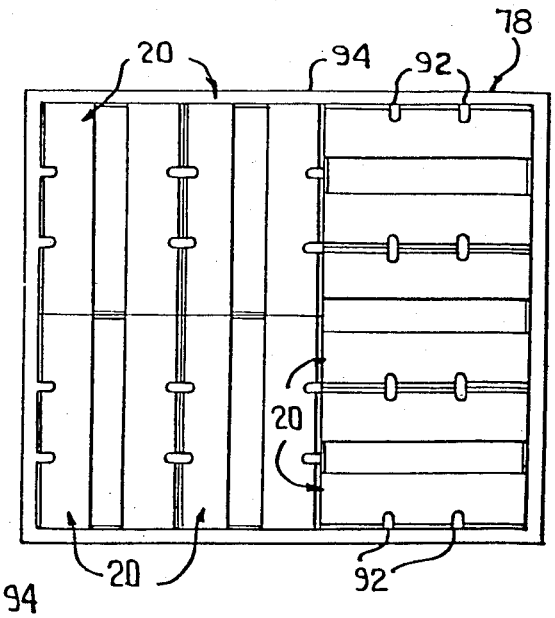
FIG. 10 is a plan view of the loaded pallet of FIG. 9.

It is to be understood, for a typical construction, that the width of each box 78 is on the order of two-thirds of the length of the box. Thus, as is best shown in FIG. 10, seven of the boxes 78 may be positioned in a row on a pallet, such as the pallet 94. Also, as is best shown in FIG. 9, the boxes 78 may be stacked six high with the arrangement of the boxes in the first three rows being identical or columnar, and the arrangement of the boxes in the top three rows being alternately reversed. These ratios may obviously be varied for particular uses.

It will also be seen from FIG. 9 that by forming the vent openings 92 at the third points on the boxes, they become aligned at the separation between adjacent boxes. Similarly, the vent opening location may be varied.

Figures 11, 12, 13, 14:
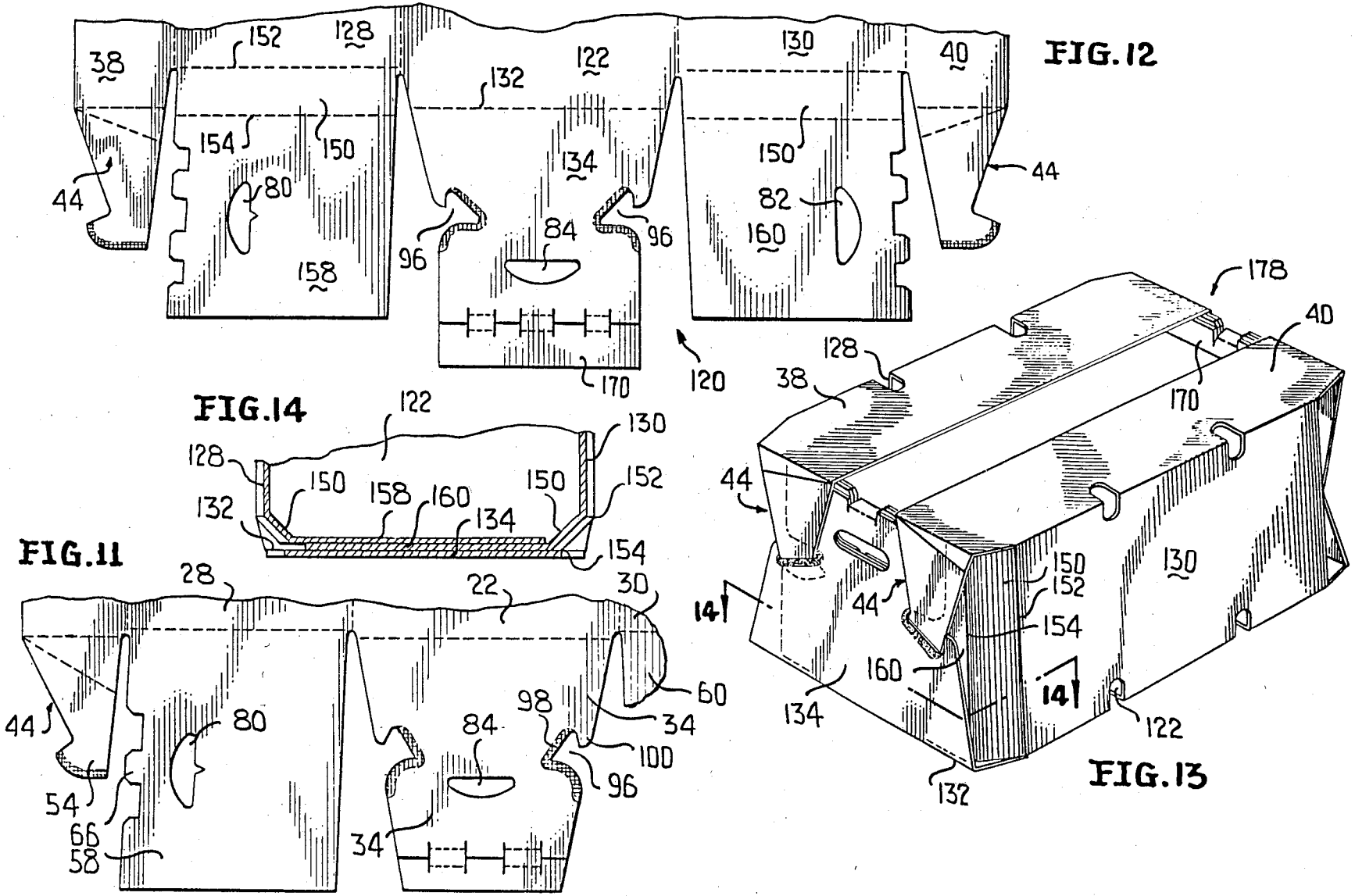
FIG. 11 is a fragmentary plan view of an end portion of a slightly modified blank wherein the lock notch is of a modified configuration.
FIG. 12 is a fragmentary plan view of an end portion of another modified form of blank wherein end panels carried by the side panels are spaced from the side panels by corner panels.
FIG. 13 is a perspective view of a box formed from the modified blank of FIG. 12.
FIG. 14 is a fragmentary horizontal sectional view taken generally along the lines 14—14 of FIG. 13 and shows the specific corner construction.

Reference is now made to FIG. 11 wherein the lock notch construction may be modified. Such a modified lock notch 96 is illustrated with respect to one of the end panels 34. The lock notch 96 has a recessed tapered locking edge 98 and there is at the lower end of the locking edge 98 a lower detent 100 so as to more fully cooperate with the bent elbow hook 54 and retain the hook in interlocking engagement with the locking edge 98.

In FIG. 12 there is illustrated a slightly modified form of carton blank, generally identified by the numeral 120.

The blank 120 includes a central bottom panel 122 having on opposite sides thereof end panels 128 and 130 similar to the end panels 28, 30. The side panels 128, 130 carry closure panels 38 and 40, respectively, which closure panels have at opposite ends thereof lock panels 44.

The blank 120 differs from the blank 20 in that in lieu of end panels 158, 160 directly at opposite ends of the side panels 128, 130, between each of the end panels 158, 160 and its respective side panel 128, 130, there is a corner panel 150 which is connected to the respective side panel 128, 130, along with a hinge or fold line 152 and to the respective end panel 158 or 160 along a fold or hinge line 154.

There is also a modified end panel 134 carried by opposite ends of the bottom panel 122. Each of the end panels 134 is provided with a lock notch 96 as described above. Beyond the lock notches 96, the end panel 134 is of a constant width and terminates in a locking flap 170.

The resultant box 178 of FIG. 13 is erected in the same manner as described with respect to the box 78, but the corners thereof are defined by the corner panels 150 as is clearly shown in FIGS. 13 and 14.

Referring now to the embodiment of FIGS. 15–19, another blank and procedure box is illustrated, the blank also being formed of corrugated board which may include a wet strength liner and medium, as well as special water repellent inside coatings. Each of a plurality of panels is hingedly connected along fold or hinge lines perpendicular to the longitudinal axis L of the blank. All hinge lines are denoted by dashed lines. A first half side wall forming panel 220 is hingedly connected to box end panel 222, the latter including a hand receiving aperture 224 and a pair of spaced locking tab receiving apertures 226 generally triangular in outline. The upper edge (referring to the blank orientation shown at FIG. 15) of end panel 222 includes a central relief or recess 228. The numeral 230 denotes a full side wall forming panel hingedly connected to end panel 222 transversely of longitudinal axis L and also hingedly connected to a second box end panel 232. End panel 232 is of a configuration identical to that of end panel 222. The last panel or right most of the series of panels articulated along longitudinal axis L is denoted by the numeral 234 and is also a half side wall forming panel.

The numerals 202, 204, 208, 212 and 216 denote bottom forming panels hinged along an axis parallel to longitudinal axis L, being hinged to the bottoms of, respectively, panels 220, 222, 230, 232 and 234. Bottom forming panel 204 carries a notched away portion 206, with the central bottom forming panel 208 carrying a pair of notched away portions denoted each by the numeral 210, while bottom forming panel 212 is provided with a notched or cut away portion 214. These bottom forming panels form, in the erected box, a snap lock bottom, such a bottom itself being known in this art.

The numeral 240 denotes a half top or upper closure panel hingedly connected to the upper portion of panel 220, with the right hand portion (viewed at FIG. 15) of panel 240 carrying hinged locking panel 246 so configured as to include a locking ear 248. A hinge line 244 extends at a slight angle from the upper corner of the locking panel down to its lower edge. Full upper or top closure panel 254 carries on its left edge a locking panel 250, this panel also including a locking ear 248 and a hinge line 244. Locking panels 246 and 250 are mirror configurations of each other. The solid lines below locking panels 246 and 250 denote cut lines extending completely through the blank. Thus, locking panels 246 and 250 are free to swing away from the top edge of end panel 222. Another pair of locking panels 256 and 258 is positioned above the other end panel 232. Locking panels 256 and 258 are identical in form and structure to locking panels 256 and 250 and are hingedly connected, respectively, to full top closure panel 254 and half top closure panel 260, the hinge connections being along axes orthogonal to axis L.

Figure 15:
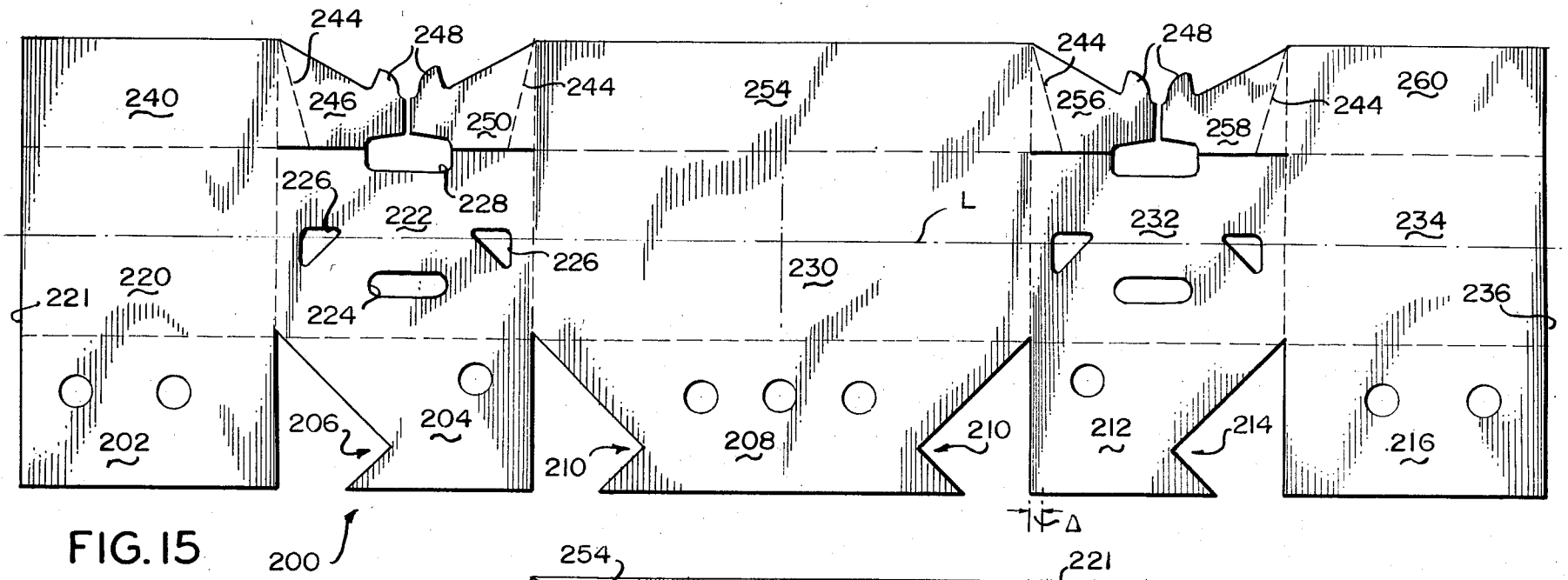
FIG. 15 is a plan view of a blank from which yet another modification of a produce box is formed.
Figure 16:
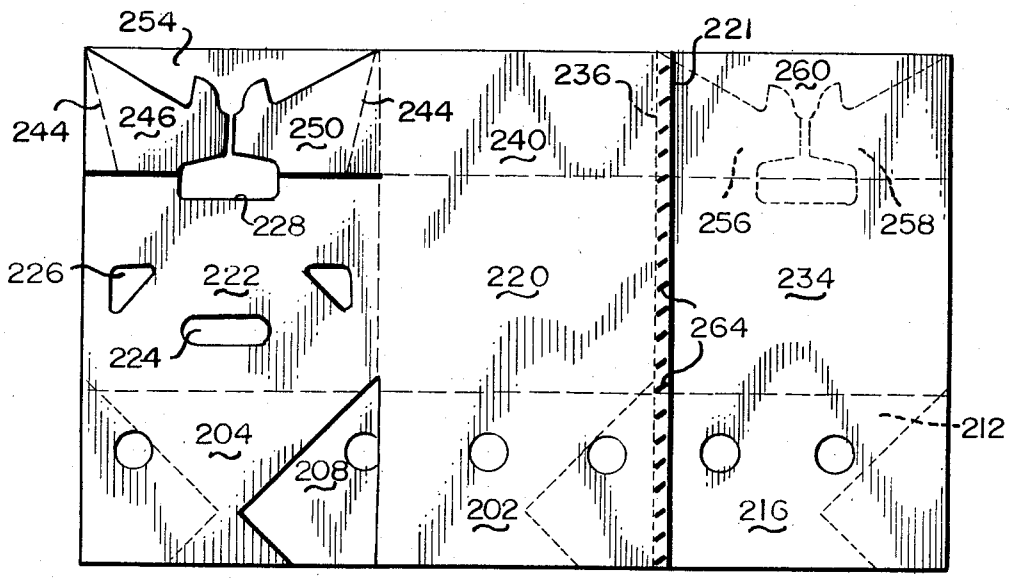
FIG. 16 is a plan view of the blank of FIG. 1, after its ends have been secured together as by staples to thereby form a tube, with the tube being folded flat and ready for setting up.

To form the produce box or container of this modification, the blank of FIG. 15 is folded about the hinge axis between panels 222 and 230, transverse to longitudinal axis L, and about the hinge axis between panels 232 and 234, with free edge 221 of panels 240, 220 and 202 overlapping by an amount designated as delta in FIG. 1, the free edge 236 of panels 260, 234 and 216. These two overlapped edges are secured together to form a manufacturer's joint, as by staples 264, to thereby define a juncture or seam denoted generally by the numeral 265. In FIG. 16, the free edges 221 and 236 have been joined as indicated and the resultant rectangular tube has been folded to a flat condition with panels 220, 222 and 234 overlying panels 230 and 232. This flattened, assembled blank may now be shipped from its place of manufacture to the packer or user and is ready for setting up or erection. To set up the folded produce box, the right and left (FIG. 16) ends are forced together so as to thereby form a generally rectangular tube. Next, bottom forming panels 202, 204, 208, 212 and 216 are interengaged, as indicated at FIG. 19, to thereby form the bottom wall of the box. Next, full top or closure forming panel 254 is hinged about its longitudinally extending hinge connection with panel 230, with locking panels 250 and 256 being folded about their respective fold or hinge lines with panel 254, so as to assume the position indicated at FIG. 17. At FIG. 17, the locking panel 250 has been bent down so as to partially overlie end panel 222, with its locking tongue 248 inserted in recess 226. The other locking panel 256 carried by top panel 254 overlies the other box end panel 232, with locking tongue 248 positioned in one recess 226 of that latter panel. Similarly, the other top closure panel 240, 260 has its locking panels 246 and 248 overlying a corresponding end panel, with locking tongues 248 secured in, respectively, a corresponding locking opening 226 in corresponding end panels 222 and 232. As best seen in conjunction with locking panel 246, each fold line 244 on each locking panel facilitates the insertion of the locking ears into the triangular end panel locking openings 226.

While the width of the top closure panels has been illustrated as less than half of the width of the box, it is understood that the top closure panel width may be increased. The bottom forming panels are provided with openings for ventilation. The product box of this modification may also be stacked on a pallet as indicated at FIG. 9.

The locking panels with their associated locking ears permit easy closure of the boxes, whether fully or partially loaded. No stapling or gluing operation is required for such closure, this being a particular advantage when the box is fully loaded with fruit or vegetables. It will further be noted that the box of FIGS. 15–19 exhibits these features independent of the specific bottom wall forming construction selected, for example, a regular slotted bottom or a snap lock bottom, or other bottom.

I claim:

1. A box, said box comprising a bottom panel having connected to opposite sides thereof side panels hinged thereto, an end panel hingedly connected to each end of said bottom panel, a top closure panel hingedly carried by a hinge line by each of said side panels remote from said bottom panel, and a lock panel hingedly carried by each end of said closure panels along a transverse hinge line for folding into overlapping relation with a respective one of said end panels, each lock panel being formed in two sections connected along a diagonal hinge line, each lock panel terminating in a hook and each of said end panels having a lock notch receiving a respective one of said hooks, said diagonal hinge line forming means for permitting transverse swinging movement of said hook into its respective lock notch after the corresponding closure panel has been moved to a top forming position and after said respective lock panel has been pivoted about the respective one of said transverse hinge lines.

2. A box according to claim 1 wherein said lock panel construction together with said diagonal hinge line of each permits tilting of said closure panels while maintaining said hooks in said lock notch.

3. A box according to claim 2 wherein said lock panels taper away from the longitudinal axes of respective side panels.

4. A box according to claim 1 wherein each of said side panels has hingedly connected to each end thereof an end panel, said end panels carried by said side panels at each end of said box being in overlapping relation to said end panel carried by said bottom panel.

5. A box according to claim 1 wherein each of said side panels has hingedly connected to each end thereof an end panel, all of said end panels at each end of said box being in overlapping relation.

6. A box according to claim 1 wherein each of said side panels has hingedly connected to each end thereof an end panel, all of said end panels at each end of said box being in overlapping relation, said end panels having aligned stepped upper edges, said end panels carried by said bottom panel having a locking flap interlocked with the stepped upper edges of the others of said end panels.

7. A box according to claim 4 wherein hinges lines connecting said end panels to said bottom panel and hinge lines connecting said side panels to the latter's end panels are differently spaced along said box to position said end panels for said overlapping.

8. A box according to claim 1 wherein said side panels converge from said bottom panel to automatically provide air space between adjacent boxes when stacked.

9. A box according to claim 1 wherein said side panels converge from said bottom panel to automatically provide air space between adjacent boxes when stacked, and there are vent openings formed across the hinge lines between said side panels and said closure panels.

10. A box according to claim 1 wherein each of said hook defines a reverse elbow lock.

11. A box according to claim 1 wherein each of said lock notches includes a lower detent retaining an associated hook engaged therein.

12. A box according to claim 1 wherein there is a corner panel between each side panel and a respective end panel.

13. A box according to claim 1 wherein each of said side panels has hingedly connected to each end thereof an end panel, said end panels carried by said side panels at each end of said box being in overlapping relation to said end panel carried by said bottom panel, said end panel carried by said bottom panel having means for securing all of said end panels together.

14. A box according to claim 1 in which each end panel has remote side edges and wherein said lock notch of each said end panel comprises an opening through a respective side edge of each said end panel connected to each end of said bottom panel, each end panel having remote side edges, a top closure panel hingedly carried by a hinge line by each of said side panels remote from said bottom panel, and a lock panel hingedly carried by each of said closure panels, each lock panel terminating in a hook and each of said end panels having a lock notch opening through a respective side edge receiving a respective one of said hooks.

15. A box, said box formed or stiff, resilient and bendable sheet material, such as corrugated board, comprising a bottom wall and having end panels, side panels and top closure panels with each top closure panel hingedly carried by a respective side panel along a hinge line remote from said bottom wall, and a locking panel hingedly carried at each end of said top closure panels, each locking panel carrying a locking ear hinged along a diagonal hinge line, each locking panel overlying a respective end panel exteriorly of the latter, each locking ear being received in a corresponding locking aperture in its respective end panel to hold the top closure panels in position.

16. The box of claim 15 wherein the box is erected from a flattened tube.

17. The box of claim 15 wherein the width of each top closure panel is less than half of the width of the box.

18. The box of claim 15 wherein the box is formed from a single blank of generally rectangular form, the blank defined by a plurality of panels hingedly articulated together, the ends of the blank being joined together to thereby form a tube, one end of the tube being closed at one end by interlocking panels to form the bottom wall of the box, and the other end of the tube being closed at its other end by the top closure panels.

19. The box of claim 18 wherein the ends of the blank are overlapped and secured together.

20. The box of claim 15 wherein the width of each top closure panel is no greater than one-half the width of the box.

21. The box of claim 15 wherein there is one of said locking apertures for each of said locking ears.

22. The box of claim 15 wherein there is one of said locking apertures for each of said locking ears, each of said locking apertures having a corner facing the respective locking ear.

23. The box of claim 15 wherein there is one of said locking apertures for each of said locking ears, each of said locking apertures being generally in the shape of a right angle triangle and having the right angle acting as a locking corner facing the respective locking ear.

24. A box according to claim 15 wherein there are vent openings formed across the hinge line between each of said side panels and said closure panels.

* * * * *